US012491921B2

(12) United States Patent
Chen et al.

(10) Patent No.: US 12,491,921 B2
(45) Date of Patent: Dec. 9, 2025

(54) METHOD FOR PREVENTING TURNOUT CONFLICT AND TARGET CONTROL DEVICE

(71) Applicant: BYD COMPANY LIMITED, Guangdong (CN)

(72) Inventors: Chujun Chen, Shenzhen (CN); Kaikuo Zhuo, Shenzhen (CN); Weihua Liu, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 0 days.

(21) Appl. No.: 18/542,063

(22) Filed: Dec. 15, 2023

(65) Prior Publication Data

US 2024/0116553 A1 Apr. 11, 2024

Related U.S. Application Data

(63) Continuation of application No. PCT/CN2022/117243, filed on Sep. 6, 2022.

(30) Foreign Application Priority Data

Sep. 10, 2021 (CN) ..... 202111066758.1

(51) Int. Cl.
*B61L 27/16* (2022.01)
*B61L 25/02* (2006.01)

(52) U.S. Cl.
CPC ..... *B61L 27/16* (2022.01); *B61L 25/021* (2013.01); *B61L 25/025* (2013.01)

(58) Field of Classification Search
CPC ..... B61L 27/16; B61L 27/14; B61L 25/021; B61L 25/025

(Continued)

(56) References Cited

U.S. PATENT DOCUMENTS 12,024,212 B2 * 7/2024 Xia ..... B61L 15/0027

FOREIGN PATENT DOCUMENTS

CN 104670267 A 6/2015
CN 107571889 A 1/2018

(Continued)

OTHER PUBLICATIONS

International Search Report and Written Opinion for Application No. PCT/CN2022/117243, mailed on Nov. 11, 2022, 11 pages.

(Continued)

*Primary Examiner* — Hai H Huynh
(74) *Attorney, Agent, or Firm* — Sheppard Mullin Richter & Hampton LLP

(57) ABSTRACT

A method for preventing a turnout conflict of a railway is applicable to a railway controller and includes: receiving a first request from a first train and a second request from a second train for using a turnout within a time period; determining whether a first distance between a current position of the first train and the turnout is equal to a second distance between a current position of the second train and the turnout; and in response to determining that the first distance is equal to the second distance, determining a priority user based on first arrival information of the first train and second arrival information of the second train, where the arrival information includes whether the train arrives at a next parking station on schedule, ahead of schedule, or behind schedule when running at a maximum running speed.

20 Claims, 2 Drawing Sheets

(58) Field of Classification Search
USPC ..... 701/19, 20
See application file for complete search history.

(56) References Cited

FOREIGN PATENT DOCUMENTS

| | | | |
|---|---|---|---|
| CN | 108010348 | A | 5/2018 |
| CN | 207790572 | U | 8/2018 |
| CN | 109080667 | A | 12/2018 |
| CN | 110509954 | A | 11/2019 |
| CN | 111791923 | A | 10/2020 |
| CN | 111874036 | A | 11/2020 |
| CN | 111923966 | A | 11/2020 |
| CN | 112124360 | A | 12/2020 |
| CN | 112466115 | A | 3/2021 |
| CN | 112590889 | A | 4/2021 |

OTHER PUBLICATIONS

Second Office Action and Supplementary Search Report dated Jun. 26, 2025, issued in related Chinese Patent Application No. 202111066758.1, with English machine translation (13 pages).
Third Office Action and Supplementary Search dated Sep. 30, 2025, issued in Chinese Patent Application No. 202111066758.1, with English machine translation (12 pages).

* cited by examiner

METHOD FOR PREVENTING TURNOUT CONFLICT AND TARGET CONTROL DEVICE

CROSS-REFERENCE TO RELATED APPLICATIONS

This application is a Continuation Application of International Patent Application No. PCT/CN2022/117243, filed on Sep. 6, 2022, which is based on and claims priority to and benefits of Chinese Patent Application No. 202111066758.1, filed on Sep. 10, 2021. The entire content of all of the above-referenced applications is incorporated herein by reference.

FIELD

The present disclosure relates to the technical field of rail transit, and in particular, to a method for preventing a turnout conflict and a target control device.

BACKGROUND

In the related art, a train running control system based on vehicle-to-vehicle communication may directly obtain a state of a device on a line and control the device on the line according to safety logic. The train running control system based on vehicle-to-vehicle communication includes a target control device (OC), and the OC is configured to manage trackside devices such as turnouts and signal devices on the line.

In the train running control system based on vehicle-to-vehicle communication, mainly two methods for preventing a turnout conflict are provided. The first method is that an automatic train monitoring system prevents the turnout conflict according to a running plan. Specifically, the automatic train monitoring system prepares the running plan for all trains on the entire line. During the preparation of the running plan, a situation of multi-vehicle turnout conflict is considered, to avoid the conflict according to the running plan. The second method is that the target control device (OC) uses a reasonable control mechanism to ensure that only one vehicle can use the turnout at a certain moment. However, due to the situation of trains arriving ahead of schedule or behind schedule, two trains may apply to use a turnout at the same time when being at the same distance from the turnout, and the existing method for dealing with a turnout conflict may aggravate the delay of trains.

SUMMARY

In order to solve the above technical problems, the present disclosure provides a method for preventing a turnout conflict and a target control device. When distances from a first train and a second train to a turnout are the same, and the first train and the second train simultaneously send requests to use the turnout, a priority user of the turnout may be determined based on information of next parking stations at which the first train and the second train respectively arrive, so that train operation efficiency and a train punctuality rate can be enhanced.

A first aspect of the present disclosure provides a method for preventing a turnout conflict of a railway, applicable to a railway controller. The method includes: receiving a first request from a first train and a second request from a second train for using a turnout within a time period; determining whether a first distance between a current position of the first train and the turnout is equal to a second distance between a current position of the second train and the turnout; and in response to determining that the first distance is equal to the second distance, determining a priority user based on first arrival information of the first train and second arrival information of the second train, where the first arrival information includes whether the first train arrives at a first next parking station of the first train on schedule, ahead of schedule, or behind schedule when running at a first maximum running speed, and the second arrival information includes whether the second train arrives at a second next parking station of the second train on schedule when running at a second maximum running speed.

In some embodiments of the present disclosure, the determining a priority user of the turnout based on first arrival information of the first train and second arrival information of the second train includes: in response to that the first arrival information indicates that the first train arrives at the first next parking station ahead of schedule or on schedule when running at the first maximum running speed and the second arrival information indicates that the second train arrives at the second next parking station behind schedule when running at the second maximum running speed, determining the second train is the priority user of the turnout.

In some embodiments of the present disclosure, when the first arrival information indicates that the first train arrives at the first next parking station behind schedule when running at the first maximum running speed and the second arrival information indicates that the second train arrives at the second next parking station behind schedule when running at the second maximum running speed, the prevention method further includes: determining a first running time for the first train to run to the first next parking station from the current position of the first train and a second running time for the second train to run to the second next parking station from the current position of the second train; and determining the priority user of the turnout based on the first running time and the second running time.

In some embodiments of the present disclosure, the first train is determined as the priority user of the turnout if the first running time is greater than the second running time.

In some embodiments of the present disclosure, the priority user of the turnout is determined based on a use priority order of the turnout if the first running time is equal to the second running time.

In some embodiments of the present disclosure, the priority user of the turnout is determined based on the use priority order of the turnout when the first arrival information indicates that the first train arrives at the first next parking station ahead of schedule or on schedule when running at the first maximum running speed and the second arrival information indicates that the second train arrives at the second next parking station ahead of schedule or on schedule when running at the second maximum running speed.

In some embodiments of the present disclosure, the first train is determined as the priority user of the turnout if the first distance is less than the second distance.

In some embodiments of the present disclosure, after the determining a priority user of the turnout, the prevention method further includes: granting a right to use the turnout to the priority user of the turnout; and granting the right to use the turnout to the other one of the first train and the second train after the priority user of the turnout leaves the turnout.

A second aspect of the present disclosure provides a railway controller. The railway controller includes a memory and a processor, the memory storing a computer program, the processor being configured to execute the computer program to perform the method for preventing a turnout conflict described above.

A third aspect of the present disclosure provides a non-transitory computer-readable storage medium, the non-transitory computer-readable storage medium storing a computer program, the computer program being configured to be executed by a processor to perform the method for preventing a turnout conflict described above.

According to the method for preventing a turnout conflict and the target control device (or railway controller) provided in the present disclosure, when the distance between the first train and the turnout is equal to the distance between the second train and the turnout, and the first train and the second train simultaneously send requests to use the turnout, the priority user of the turnout is determined depending on whether the first train arrives at the next parking station of the first train ahead of schedule, on schedule, or behind schedule and whether the second train arrives at the next parking station of the second train on schedule, so that train operation efficiency and a train punctuality rate can be enhanced.

BRIEF DESCRIPTION OF THE DRAWINGS

To describe the technical solutions in the present disclosure more clearly, the following briefly introduces the accompanying drawings required for describing the implementations. The accompanying drawings in the following description show merely some implementations of the present disclosure, and a person of ordinary skill in the art may still derive additional accompanying drawings without creative efforts.

DETAILED DESCRIPTION

The following describes the technical solutions in the embodiments of the present disclosure with reference to the accompanying drawings in the embodiments of the present disclosure. The described embodiments are merely some of the embodiments of the present disclosure rather than all of the embodiments. Other embodiments obtained by a person of ordinary skill in the art based on the embodiments of the present disclosure without creative efforts shall fall within the protection scope of the present disclosure.

In the description of the present disclosure, the terms such as "first" and "second" are used for distinguishing between different objects rather than being used for describing a particular order, and therefore cannot be understood as a limitation on the present disclosure.

Figure 1:
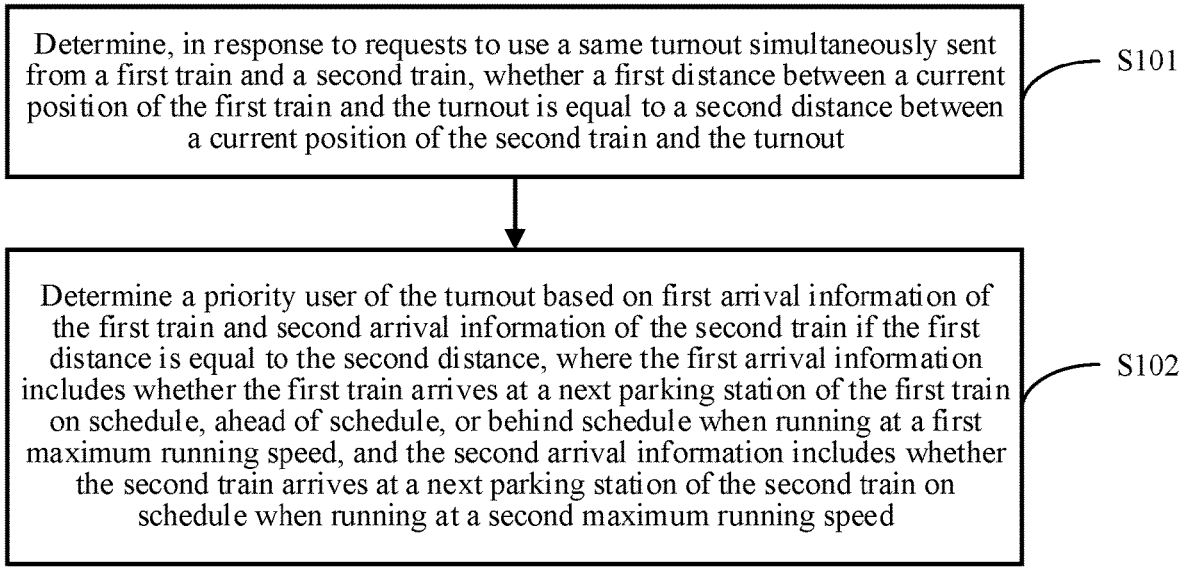
FIG. 1 is a flowchart of a method for preventing a turnout conflict according to an embodiment of the present disclosure.

FIG. 1 is a flowchart of a method for preventing a turnout conflict of a railway according to an embodiment of the present disclosure. The method for preventing a turnout conflict is applicable to a target control device or a railway controller. The target control device is configured to control the use of a turnout. As shown in FIG. 1, the method includes the following steps.

S101: It is determined, in response to requests to use a same turnout simultaneously sent from a first train and a second train, whether a first distance between a current position of the first train and the turnout is equal to a second distance between a current position of the second train and the turnout.

S102: A priority user of the turnout is determined based on first arrival information of the first train and second arrival information of the second train if the first distance is equal to the second distance. The first arrival information includes whether the first train arrives at a next parking station of the first train on schedule, ahead of schedule, or behind schedule when running at a first maximum running speed. The second arrival information includes whether the second train arrives at a next parking station of the second train on schedule when running at a second maximum running speed. The maximum running speed is the highest speed at which the train could operate based on the route condition and the train performance.

According to the method for preventing a turnout conflict provided in this embodiment of the present disclosure, when the distance between the first train and the turnout is equal to the distance between the second train and the turnout, and the requests to use the turnout from the first train and the second train are received simultaneously, the priority user of the turnout is determined depending on whether the first train arrives at the next parking station of the first train ahead of schedule, on schedule, or behind schedule and whether the first train arrives at the next parking station of the first train on schedule, so that train operation efficiency and a train punctuality rate can be enhanced. When the requests sent from the first train and the second train to use the turnout are received within a certain time period, for example, within 1 second, the requests are considered to be received simultaneously.

The first train and the second train may run in opposite directions or in the same direction.

A current position of the first train is a position of the first train when sending a request for use the turnout, and a current position of the second train is a position of the second train when sending a request for use the turnout.

The turnout may be located between the first train and the second train, located between the current position of the first train and the next parking station of the first train, or located between the current position of the second train and the next parking station of the second train.

In some embodiments, after the determining the priority user of the turnout, the method for preventing a turnout conflict may further include the following steps. A right to use the turnout is granted to the priority user of the turnout. The right to use the turnout is granted to the other train after the priority user of the turnout leaves the turnout. In an embodiment, when the right to use the turnout is granted to the priority user of the turnout, information of authorization failure is fed back to the other train, and the turnout is moved and locked. The train that has obtained the right to use the turnout runs through the turnout section, and the other train that has obtained the information of authorization failure continuously sends the request to use the turnout. After the train that has obtained the right to use the turnout leaves the turnout section, the target control device grants the right to use the turnout to the other train that has obtained the information of authorization failure. For example, when it is determined that the priority user of the turnout is the first train, the right to use the turnout is granted to the first train, the information of authorization failure is fed back to the second train, and the turnout is moved and locked. The first train runs through the turnout section, and the second train still continuously sends the request to use the turnout after receiving the message of authorization failure. After the first train leaves the turnout section, the target control device grants the use right of the turnout to the second train.

In some embodiments, the foregoing step S102 of determining a priority user of the turnout based on first arrival information of the first train and second arrival information of the second train includes the following step. It is determined that the second train is the priority user of the turnout when the first arrival information includes that the first train arrives at the next parking station of the first train ahead of schedule or on schedule when running at the first maximum running speed and the second arrival information includes that the second train arrives at the next parking station of the second train behind schedule when running at the second maximum running speed. By giving priority to the second train that arrives behind schedule to use the turnout, the second train can be prevented from being delayed for too long.

After it is determined that the second train is the priority user of the turnout, the target control device grants the right to use the turnout to the second train, feeds back the information of authorization failure to the first train, and controls the turnout to move and lock. The second train runs through the turnout section, and the first train continuously sends the request to use the turnout after receiving the information of authorization failure. After the second train leaves the turnout section, the target control device grants the right to use the turnout to the first train.

In an embodiment, it is determined that the first train is the priority user of the turnout when the first arrival information includes that the first train arrives at the next parking station of the first train behind schedule when running at a first maximum running speed and the second arrival information includes that the second train arrives at the next parking station of the second train ahead of schedule or on schedule when running at a second maximum running speed.

In some embodiments, when the first arrival information includes that the first train arrives at the next parking station of the first train behind schedule when running at the first maximum running speed and the second arrival information includes that the second train arrives at the next parking station of the second train behind schedule when running at the second maximum running speed, the prevention method further includes the following steps. A first running time for the first train to run to the next parking station of the first train and a second running time for the second train to run to the next parking station of the second train are determined. The priority user of the turnout is determined based on the first running time and the second running time.

The first running time includes a time required for the first train to run to the next parking station of the first train at the first maximum running speed of the first train, and the second running time includes a time required for the second train to run to the next parking station of the second train at the second maximum running speed of the second train.

In some embodiments, the first train is determined as the priority user of the turnout if the first running time is greater than the second running time. When both the first train and the second train arrive at the turnout behind schedule, the first train that runs for a longer time is given priority to use the turnout, so that the first train can be prevented from being delayed for too long.

After it is determined that the first train is the priority user of the turnout, the target control device grants the right to use the turnout to the first train, feeds back the information of authorization failure to the second train, and controls the turnout to move and lock. The first train runs through the turnout section, and the second train continuously sends the request to use the turnout after receiving the information of authorization failure. After the first train leaves the turnout section, the target control device grants the right to use the turnout to the second train.

If the first running time for the first train to run to the next parking station of the first train is less than the second running time for the second train to run to the next parking station of the second train, it is determined that the second train is the priority user of the turnout.

In some other embodiments, the priority user of the turnout is determined based on preset order of use priorities (e.g., a use priority order of the turnout) if the first running time is equal to the second running time. The preset order of use priorities may be determined based on a normal position priority principle. In an embodiment, the normal position refers to a frequently used position of the turnout, and a reverse position refers to an infrequently used position of the turnout. Generally, a straight track is considered as a normal position, and a curved track is considered as a reverse position, which means that a position through which a train passes along a straight line is a normal position. When the first running time of the first train is equal to the second running time of the second train, the position applied by the first train is the normal position of the turnout, and the position applied by the second train is the reverse position of the turnout, it is determined that the first train is the priority user of the turnout, and vice versa.

In another embodiment, the preset order of use priorities may be determined based on a preset train running plan. For example, in the preset train running plan, if the first train uses the turnout preferentially, it is determined that the first train is the priority user of the turnout.

In some embodiments, the determining a priority user of the turnout based on first arrival information of the first train and second arrival information of the second train includes the following step. The priority user of the turnout is determined based on the preset order of use priorities when the first arrival information includes that the first train arrives at the next parking station of the first train ahead of schedule or on schedule when running at the first maximum running speed and the second arrival information includes that the second train arrives at the next parking station of the second train ahead of schedule or on schedule when running at the second maximum running speed. The preset order of use priorities may be determined based on a normal position priority principle. In an embodiment, the normal position refers to a frequently used position of the turnout, and a reverse position refers to an infrequently used position of the turnout. Generally, a straight track is considered as a normal position, and a curved track is considered as a reverse position, which means that a position through which a train passes along a straight line is a normal position. When both the first train and the second train arrive at the next parking station of the first train ahead of schedule or on schedule, the position applied by the first train is the normal position of the turnout, and the position applied by the second train is the reverse position of the turnout, it is determined that the first train is the priority user of the turnout, and vice versa.

In another embodiment, the preset order of use priorities may be determined based on a preset train running plan. For example, in the preset train running plan, if the first train uses the turnout preferentially, it is determined that the first train is the priority user of the turnout.

In some embodiments, the first distance between the current position of the first train and the turnout is less than the second distance between the current position of the second train and the turnout, and it is determined that the first train is the priority user of the turnout, so that the first train closer to the turnout has priority to use the turnout.

When the first distance between the current position of the first train and the turnout is greater than the second distance between the current position of the second train and the turnout, it is determined that the second train is the priority user of the turnout.

According to the method for preventing a turnout conflict provided in this embodiment of the present disclosure, when distances between the first train and the second train and the turnout are the same, and the first train and the second train simultaneously send requests to use the turnout, the priority user of the turnout may be determined based on information that the first train and the second train respectively arrive at corresponding next parking stations, so that train operation efficiency and a train punctuality rate can be enhanced.

Figure 2:
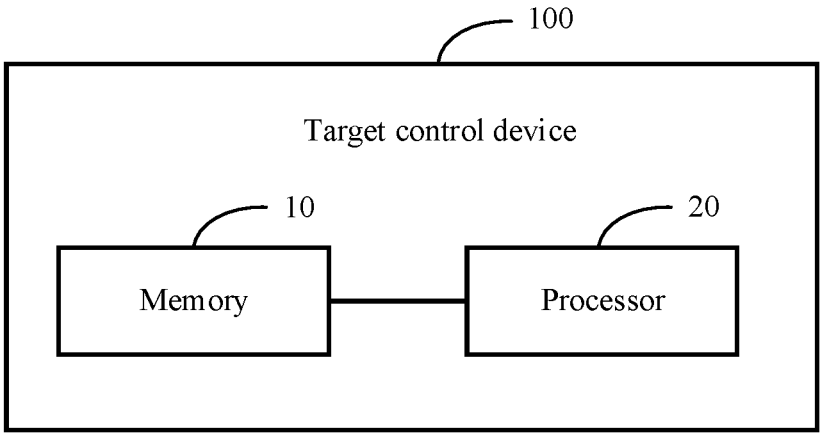
FIG. 2 is a structural block diagram of a target control device according to an embodiment of the present disclosure.

FIG. 2 is a structural block diagram of a target control device 100 according to an embodiment of the present disclosure. As shown in FIG. 2, the target control device 100 includes a memory 10 and a processor 20. The memory 10 stores a computer program, the computer program being configured to be executed by the processor 20 to perform the method for preventing a turnout conflict provided in any of the foregoing embodiments.

For example, the processor 20 is configured to respond to the request to use the same turnout simultaneously sent from the first train and the second train, and determine whether the first distance between the current position of the first train and the turnout is equal to the second distance between the current position of the second train and the turnout. A priority user of the turnout is determined based on first arrival information of the first train and second arrival information of the second train if the first distance is equal to the second distance. The first arrival information includes whether the first train arrives at a next parking station of the first train on schedule, ahead of schedule, or behind schedule when running at a first maximum running speed, and the second arrival information includes whether the second train arrives at a next parking station of the second train on schedule when running at a second maximum running speed.

The first train and the second train may run in opposite directions or in the same direction.

The processor 20 is further configured to grant a right to use the turnout to the priority user of the turnout after determining the priority user of the turnout and grant the right to use the turnout to the other train after the priority user of the turnout leaves the turnout. In an embodiment, when the right to use the turnout is granted to the priority user of the turnout, information of authorization failure is fed back to the other train, and the turnout is moved and locked. The train that has obtained the right to use the turnout runs through the turnout section, and the train that has obtained the information of authorization failure continuously sends the request to use the turnout. After the train that has obtained the right to use the turnout leaves the turnout section, the processor 20 is further configured to grant the right to use the turnout to the train that has obtained the information of authorization failure. For example, when it is determined that the priority user of the turnout is the first train, the processor 20 grants the right to use the turnout to the first train, feeds back the information of authorization failure to the second train, and controls the turnout to move and lock. The first train runs through the turnout section, and the second train still continuously sends the request to use the turnout after receiving the message of authorization failure. After the first train leaves the turnout section, the processor 20 grants the use right of the turnout to the second train.

The determining a priority user of the turnout based on first arrival information of the first train and second arrival information of the second train by the processor 20 may include the following step. It is determined that the second train is the priority user of the turnout based on information that the first train arrives at the next parking station of the first train ahead of schedule or on schedule when running at a first maximum running speed, and information that the second train arrives at the next parking station of the second train behind schedule when running at a second maximum running speed. By giving priority to the second train that arrives behind schedule to use the turnout, the second train can be prevented from being delayed for too long.

It is determined that the first train is the priority user of the turnout when the first train arrives at the next parking station of the first train behind schedule when running at a first maximum running speed, and the second train arrives at the next parking station of the second train ahead of schedule or on schedule when running at a second maximum running speed.

The processor 20 obtains the first running time for the first train to run to the next parking station of the first train and the second running time for the second train to run to the next parking station of the second train when determining that the first train arrives at the next parking station of the first train behind schedule and the second train arrives at the next parking station of the second train behind schedule. If the first running time is greater than the second running time, it is determined that the first train is the priority user of the turnout, and if the first running time for the first train to run to the next parking station of the first train is less than the second running time for the second train to run to the next parking station of the second train, it is determined that the second train is the priority user of the turnout.

When both the first train and the second train arrive at the turnout behind schedule, the first train that runs for a longer time is given priority to use the turnout, so that the first train can be prevented from being delayed for too long.

The preset order of use priorities may be determined based on a normal position priority principle. In an embodiment, the normal position refers to a frequently used position of the turnout, and a reverse position refers to an infrequently used position of the turnout. Generally, a straight track is considered as a normal position, and a curved track is considered as a reverse position, which means that a position through which a train passes along a straight line is a normal position. When the first running time of the first train is equal to the second running time of the second train, the position applied by the first train is the normal position of the turnout, and the position applied by the second train is the reverse position of the turnout, it is determined that the first train is the priority user of the turnout, and vice versa.

In another embodiment, the preset order of use priorities may be determined based on a preset train running plan. For example, in the preset train running plan, if the first train uses the turnout preferentially, it is determined that the first train is the priority user of the turnout.

The determining a priority user of the turnout based on first arrival information of the first train and second arrival information of the second train by the processor 20 may further include the following step. The priority user of the turnout is determined based on the preset order of use priorities when it is determined that the first train arrives at the next parking station of the first train ahead of schedule or on schedule and that the second train arrives at the next parking station of the second train ahead of schedule or on schedule. The preset order of use priorities may be determined based on a normal position priority principle. In an embodiment, the normal position refers to a frequently used position of the turnout, and a reverse position refers to an infrequently used position of the turnout. Generally, a straight track is considered as a normal position, and a curved track is considered as a reverse position, which means that a position through which a train passes along a straight line is a normal position. When both the first train and the second train arrive at the next parking station of the first train ahead of schedule or on schedule, the position applied by the first train is the normal position of the turnout, and the position applied by the second train is the reverse position of the turnout, it is determined that the first train is the priority user of the turnout, and vice versa.

In another embodiment, the preset order of use priorities may be determined based on a preset train running plan. For example, in the preset train running plan, if the first train uses the turnout preferentially, it is determined that the first train is the priority user of the turnout.

The processor 20 determines that the first train is the priority user of the turnout when determining that the first distance between the current position of the first train and the turnout is less than the second distance between the current position of the second train and the turnout, so that the first train closer to the turnout has priority to use the turnout.

The processor 20 may be a processing chip such as a central processing unit (CPU), a microcontroller, a single chip microcomputer, and a digital signal processor. The memory 10 may be a storage device such as a solid-state memory or a memory card.

According to the target control device 100 provided in this embodiment of the present disclosure, when distances between the first train and the second train and the turnout are the same, and the first train and the second train simultaneously send requests to use the turnout, the priority user of the turnout may be determined based on information that the first train and the second train respectively arrive at corresponding next parking stations, so that train operation efficiency and a train punctuality rate can be enhanced.

An embodiment of the present disclosure further provides a computer-readable storage medium, the computer-readable storage medium storing a computer program, the computer program being configured to be executed by a computer to perform the method for preventing a turnout conflict provided in any of the foregoing embodiments.

An embodiment of the present disclosure further provides a computer program product. The computer program product includes a non-transitory computer-readable storage medium storing a computer program, and the computer program is operable to cause a computer to perform the method for preventing a turnout conflict provided in any of the foregoing embodiments.

It should be noted that, for brief description, the foregoing method embodiments are represented as a series of action combinations. However, it is to be appreciated by a person skilled in the art that the present disclosure is not limited to the described order of the actions, because some steps may be performed in other orders or simultaneously according to the present disclosure. In addition, it is to be appreciated by a person skilled in the art that the embodiments described in the specification all belong to preferred embodiments, and the involved actions and modules are not necessary for the present disclosure.

In the foregoing embodiments, the descriptions of each embodiment have different focuses, and for a part that is not described in detail in an embodiment, reference may be made to the relevant description of other embodiments.

The above are the implementations of the embodiments of the present disclosure. It should be noted that, a person of ordinary skill in the art can further make several improvements and refinements without departing from the principle of the embodiments of the present disclosure, and these improvements and refinements shall fall within the protection scope of the present disclosure.

What is claimed is:

1. A method for preventing a turnout conflict of a railway, applicable to a railway controller, the method comprising:

receiving a first request for using a turnout from a first train and a second request for using the turnout from a second train within a time period;

determining whether a first distance between a current position of the first train and the turnout is equal to a second distance between a current position of the second train and the turnout; and in response to determining that the first distance is equal to the second distance, determining a priority user of the turnout based on first arrival information of the first train and second arrival information of the second train, wherein the first arrival information comprises whether the first train arrives at a first next parking station of the first train on schedule, ahead of schedule, or behind schedule when running at a first maximum running speed, and the second arrival information comprises whether the second train arrives at a second next parking station of the second train on schedule when running at a second maximum running speed.

2. The method according to claim 1, wherein the determining the priority user of the turnout based on the first arrival information of the first train and the second arrival information of the second train comprises:

in response to that the first arrival information indicates that the first train arrives at the first next parking station ahead of schedule or on schedule when running at the first maximum running speed and the second arrival information indicates that the second train arrives at the second next parking station behind schedule when running at the second maximum running speed, determining the second train is the priority user of the turnout.

3. The method according to claim 1, wherein the determining the priority user of the turnout based on the first arrival information of the first train and the second arrival information of the second train comprises:

in response to that the first arrival information indicates that the first train arrives at the first next parking station behind schedule when running at the first maximum running speed and the second arrival information indicates that the second train arrives at the second next parking station behind schedule when running at the second maximum running speed, determining a first running time for the first train to run to the first next parking station from the current position of the first train and a second running time for the second train to run to the second next parking station from the current position of the second train; and determining the priority user of the turnout based on the first running time and the second running time.

4. The method according to claim 3, wherein the determining the priority user of the turnout based on the first running time and the second running time comprises: in response to determining that the first running time is greater than the second running time, determining the first train is the priority user of the turnout.

5. The method according to claim 3, wherein the determining the priority user of the turnout based on the first running time and the second running time comprises: in response to determining that the first running time is equal to the second running time, determining the priority user of the turnout based on a use priority order of the turnout.

6. The method according to claim 1, wherein the determining the priority user of the turnout based on the first arrival information of the first train and the second arrival information of the second train comprises:

in response to that the first arrival information indicates that the first train arrives at the first next parking station ahead of schedule or on schedule when running at the first maximum running speed and the second arrival information indicates that the second train arrives at the second next parking station ahead of schedule or on schedule when running at the second maximum running speed, determining the priority user of the turnout based on a use priority order of the turnout.

7. The method according to claim 1, further comprising: in response to determining that the first distance is less than the second distance, determining the first train is the priority user of the turnout.

8. The method according to claim 1, further comprising:

granting a right to use the turnout to the priority user of the turnout; and granting the right to use the turnout to the other one of the first train and the second train after the priority user of the turnout leaves the turnout.

9. A railway controller, comprising a memory and a processor, the memory storing a computer program, the processor being configured to execute the computer program to perform operations comprising:

receiving a first request for using a turnout from a first train and a second request for using the turnout from a second train within a time period;

determining whether a first distance between a current position of the first train and the turnout is equal to a second distance between a current position of the second train and the turnout; and in response to determining that the first distance is equal to the second distance, determining a priority user of the turnout based on first arrival information of the first train and second arrival information of the second train, wherein the first arrival information comprises whether the first train arrives at a first next parking station of the first train on schedule, ahead of schedule, or behind schedule when running at a first maximum running speed, and the second arrival information comprises whether the second train arrives at a second next parking station of the second train on schedule when running at a second maximum running speed.

10. The railway controller according to claim 9, wherein the determining the priority user of the turnout based on the first arrival information of the first train and the second arrival information of the second train comprises:

in response to that the first arrival information indicates that the first train arrives at the first next parking station ahead of schedule or on schedule when running at the first maximum running speed and the second arrival information indicates that the second train arrives at the second next parking station behind schedule when running at the second maximum running speed, determining the second train is the priority user of the turnout.

11. The railway controller according to claim 9, wherein the determining the priority user of the turnout based on the first arrival information of the first train and the second arrival information of the second train comprises:

in response to that the first arrival information indicates that the first train arrives at the first next parking station behind schedule when running at the first maximum running speed and the second arrival information indicates that the second train arrives at the second next parking station behind schedule when running at the second maximum running speed, determining a first running time for the first train to run to the first next parking station from the current position of the first train and a second running time for the second train to run to the second next parking station from the current position of the second train; and determining the priority user of the turnout based on the first running time and the second running time.

12. The railway controller according to claim 11, wherein the determining the priority user of the turnout based on the first running time and the second running time comprises: in response to determining that the first running time is greater than the second running time, determining the first train is the priority user of the turnout.

13. The railway controller according to claim 11, wherein the determining the priority user of the turnout based on the first running time and the second running time comprises:

in response to determining that the first running time is equal to the second running time, determining the priority user of the turnout based on a use priority order of the turnout.

14. The railway controller according to claim 9, wherein the determining the priority user of the turnout based on the first arrival information of the first train and the second arrival information of the second train comprises:

in response to that the first arrival information indicates that the first train arrives at the first next parking station ahead of schedule or on schedule when running at the first maximum running speed and the second arrival information indicates that the second train arrives at the second next parking station ahead of schedule or on schedule when running at the second maximum running speed, determining the priority user of the turnout based on a use priority order of the turnout.

15. The railway controller according to claim 9, wherein the operations further comprise: in response to determining that the first distance is less than the second distance, determining the first train is the priority user of the turnout.

16. The railway controller according to claim 9, wherein the operations further comprise:

granting a right to use the turnout to the priority user of the turnout; and granting the right to use the turnout to the other one of the first train and the second train after the priority user of the turnout leaves the turnout.

17. A non-transitory computer-readable storage medium, storing a computer program, the computer program being configured to be executed by a processor to perform operations comprising:

receiving a first request for using a turnout from a first train and a second request for using the turnout from a second train within a time period;

determining whether a first distance between a current position of the first train and the turnout is equal to a second distance between a current position of the second train and the turnout; and in response to determining that the first distance is equal to the second distance, determining a priority user of the turnout based on first arrival information of the first train and second arrival information of the second train, wherein the first arrival information comprises whether the first train arrives at a first next parking station of the first train on schedule, ahead of schedule, or behind schedule when running at a first maximum running speed, and the second arrival information comprises whether the second train arrives at a second next parking station of the second train on schedule when running at a second maximum running speed.

18. The non-transitory computer-readable storage medium according to claim 17, wherein the determining the priority user of the turnout based on the first arrival information of the first train and the second arrival information of the second train comprises:

in response to that the first arrival information indicates that the first train arrives at the first next parking station ahead of schedule or on schedule when running at the first maximum running speed and the second arrival information indicates that the second train arrives at the second next parking station behind schedule when running at the second maximum running speed, determining the second train is the priority user of the turnout.

19. The non-transitory computer-readable storage medium according to claim 17, wherein the determining the priority user of the turnout based on the first arrival information of the first train and the second arrival information of the second train comprises:

in response to that the first arrival information indicates that the first train arrives at the first next parking station behind schedule when running at the first maximum running speed and the second arrival information indicates that the second train arrives at the second next parking station behind schedule when running at the second maximum running speed, determining a first running time for the first train to run to the first next parking station from the current position of the first train and a second running time for the second train to run to the second next parking station from the current position of the second train; and determining the priority user of the turnout based on the first running time and the second running time.

20. The non-transitory computer-readable storage medium according to claim 19, wherein the determining the priority user of the turnout based on the first running time and the second running time comprises: in response to determining that the first running time is greater than the second running time, determining the first train is the priority user of the turnout.

* * * * *